United States Patent [19]

Sano

[11] Patent Number: 4,756,263

[45] Date of Patent: Jul. 12, 1988

[54] FABRIC FEED DEVICE OF A SEWING MACHINE

[75] Inventor: Yasuro Sano, Tokyo, Japan

[73] Assignee: Janome Sewing Machine Co., Ltd., Tokyo, Japan

[21] Appl. No.: 45,007

[22] Filed: Apr. 30, 1987

[30] Foreign Application Priority Data

May 16, 1986 [JP] Japan ..... 61-72699[U]

[51] Int. Cl.[4] ..... D05B 27/22

[52] U.S. Cl. ..... 112/315; 112/323

[58] Field of Search ..... 112/315, 316, 317, 314, 112/323

[56] References Cited

U.S. PATENT DOCUMENTS

| | | | |
|---|---|---|---|
| 4,095,540 | 6/1978 | Kaltenbach et al. | 112/315 |
| 4,495,877 | 1/1985 | Willenbacher | 112/315 |
| 4,512,273 | 4/1985 | Skogward | 112/323 X |
| 4,526,118 | 7/1985 | Brauch | 112/316 X |
| 4,584,955 | 4/1986 | Sano | 112/315 |
| 4,638,752 | 1/1987 | Hartwig | 112/315 X |

*Primary Examiner*—H. Hampton Hunter

*Attorney, Agent, or Firm*—Michael J. Striker

[57] ABSTRACT

According to the invention, when a fabric feed device is set to sew a fabric with the straight stitches of smaller feeding amounts (or pitches), a machine operator is not required at first as conventionally to deliberately push the front edge of the fabric forwardly deep between a feed dog and a fabric pressor. The device of the invention is designed to effectively transport and sew the front edge of the fabric at an initial stage of straight stitching of smaller feeding amount. Further according to the invention, an adjustment of smaller feed amount may be effectively carried out in case of button hole stitches and satin stitches.

7 Claims, 6 Drawing Sheets

FABRIC FEED DEVICE OF A SEWING MACHINE

BACKGROUND OF THE INVENTION

The present invention relates to a fabric feed device of a sewing machine.

Generally, a conventional fabric feed device is substantially composed of a feed dog for transporting a fabric to be sewn, a first cam for moving the feed dog up and down, a second cam for swingably moving a fork which is operatively connected to the feed dog through a rocking shaft for moving the feed dog in a horiziontal plane, and a feed regulator operatively connected to the fork to regulate the swinging movement of the fork. Thereby, the rocking movement of the rocking shaft to adjusts the movement amount of the feed dog in the horizontal plane. Thus, the feed dog is moved in a trapezoidal path, that is, horizontally moved while it is moved up and down, thereby to transport the fabric with respect to a needle.

According to the conventional device as mentioned above, if the fabric feed device is adjusted to feed (or transport) the fabric in a smaller amount in reference to the maximum forward amount C-max as shown in FIG. 11, the moving locus of the feed dog is reduced as indicated by a reference character C in which the moving amounts of the feed dog at the raised position 1.0 thereof are substantially equal on both sides of a center $D_0$ of the total horizontal movement, provided that the level 0 is a needle plate, below which the feed dog will not transport the fabric. Namely, the initial position of the feed dog for transporting the fabric is shifted away from the machine operator compared with the maximum forward feeding locus C-max.

Therefore, with a sewing machine provided with such a type of fabric feed device, the machine operator is generally required to forwardly push the front edge of the fabric deep between the feed dog and the presser foot. This is especially the case when the fabric is sewn with straight stitches of smaller pitches, such as 1.5 to 2 mm or 5 mm, which are so frequently selected.

Further, in combination with this type of the fabric feed device, a stepping motor is often employed to adjust the inclination of the feed regulator, thereby to adjust the feeding amount (or pitch) of the fabric. In this case, the maximum feeding amount may be generally obtained by dividing the feeding amount into 30 steps or less of the stepping motor in consideration of the step angle and control period of the step motor, so as to properly adjust the moderate or medium feeding amounts of the fabric. Such a way of division will be sufficient for controlling comparatively large amount of the fabric feed. It is not, however, sufficient for controlling a smaller amount (pitch) of the fabric fed, for example, in case of button hole stitches, satin stitches requiring the feeding amount 0.3 to 0.5 mm.

SUMMARY OF THE INVENTION

The present invention has been provided to eliminate the defects and disadvantages of the prior art.

The invention substantially comprises a feed dog for transporting a fabric to be sewn, a first cam for moving the feed dog up and down, a feed regulator operatively connected to the feed dog through a fork and a rocking shaft to adjust a moving amount of the feed dog in a horizontal plane, second and third cams of different effects selectively employed in dependence upon the types of stitches to be formed, the second and third cams being mounted on a rotational shaft for rotation therewith and selectively engaging the fork to swing the same thereby to rockingly move the rocking shaft to move the feed dog in the horizontal plane and means for moving the second and third cams axially of the rotational shaft with respect to the fork to selectively bring the cams into engagement with the fork.

According to the invention, when the fabric feed device is set to sew the fabric with straight stitches of smaller feeding amounts (or pitches), the machine operator is not required at first to deliberately push the front edge of the fabric forwardly deep between the feed dog and the fabric pressor. The device of the invention is designed to effectively transport and sew the front edge of the fabric at the inital stage of straight stitching of smaller feeding amount. Further according to the invention, the adjustment of smaller feed amount may be effectively carried out in case of button hole stitches and satin stitches.

DETAILED DESCRIPTION OF PREFERRED EMBODIMENTS

Figure 1:
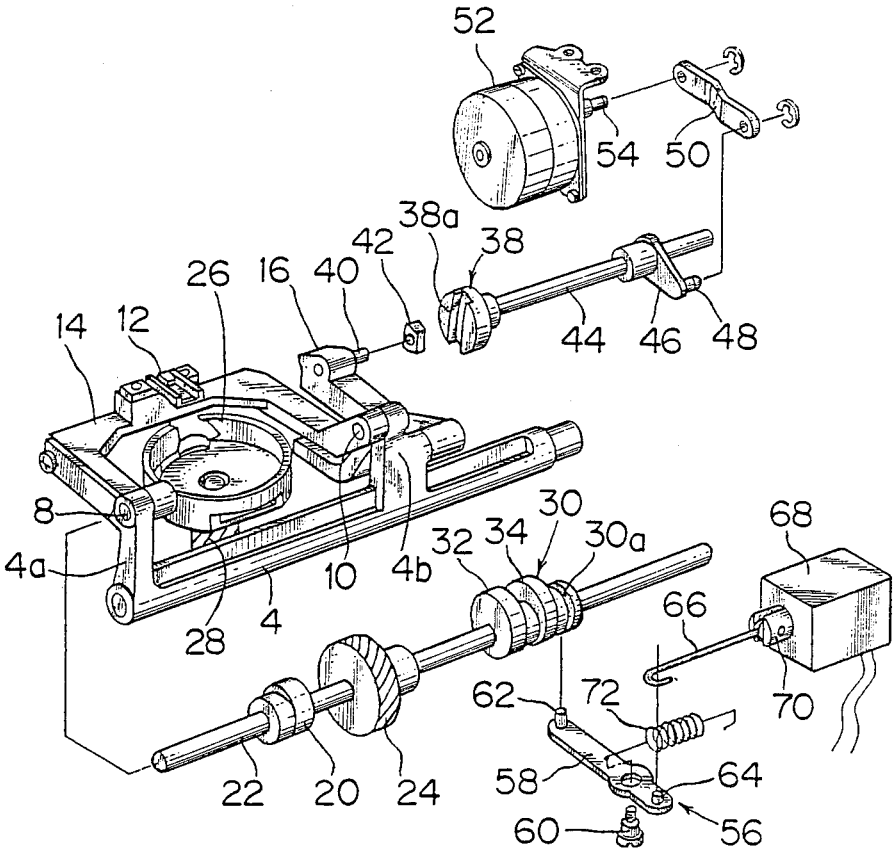
FIG. 1 shows an exploded perspective an element part of a fabric feed device according to the invention.
Figure 2:
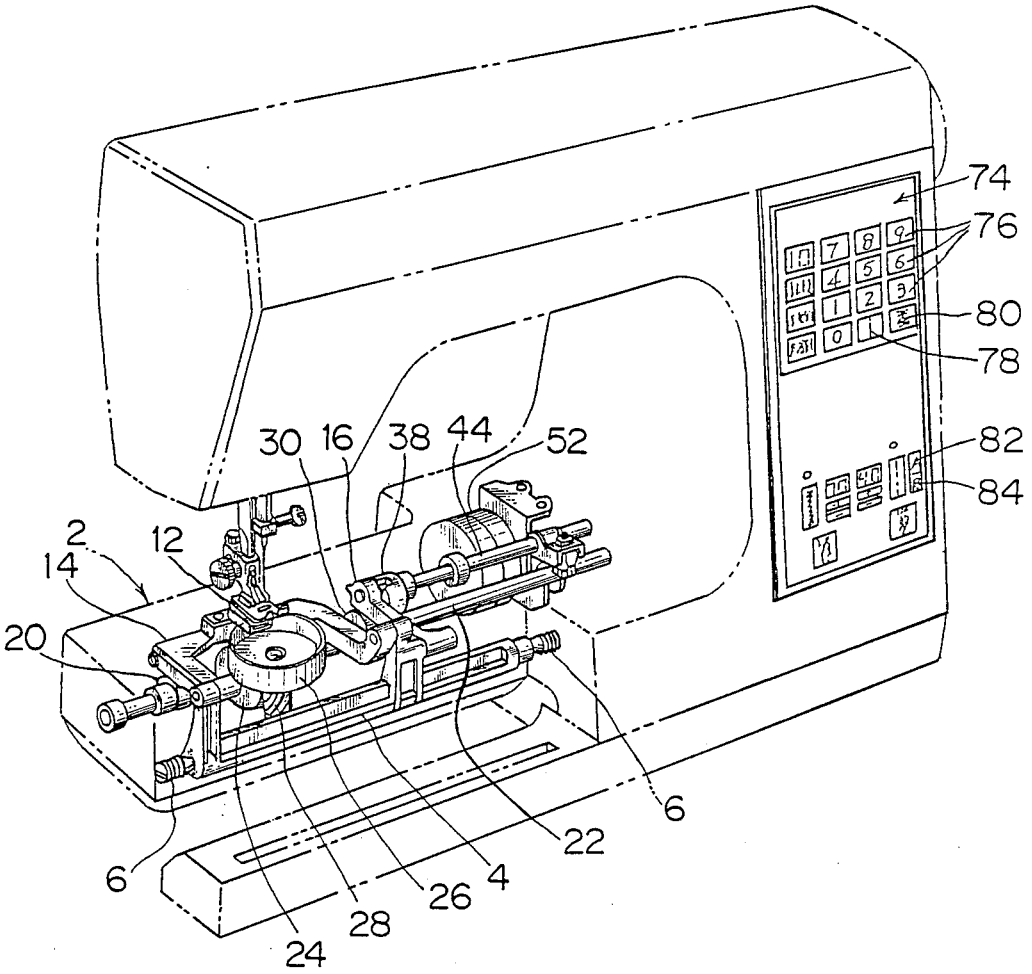
FIG. 2 shows a perspective view of the element part of a fabric feed device per FIG. 1 incorporated into a sewing machine.

FIGS. 1 and 2 show that a rocking feed shaft 4 is pivotably supported to a frame of a free arm 2 by a pair of center screws 6, 6. A U-shaped base 14 having a feed dog 12 is also pivotably held by a pair of pins 8, 10 around upper parts of arms 4*a*, 4*b* of the shaft 4.

Figure 3:
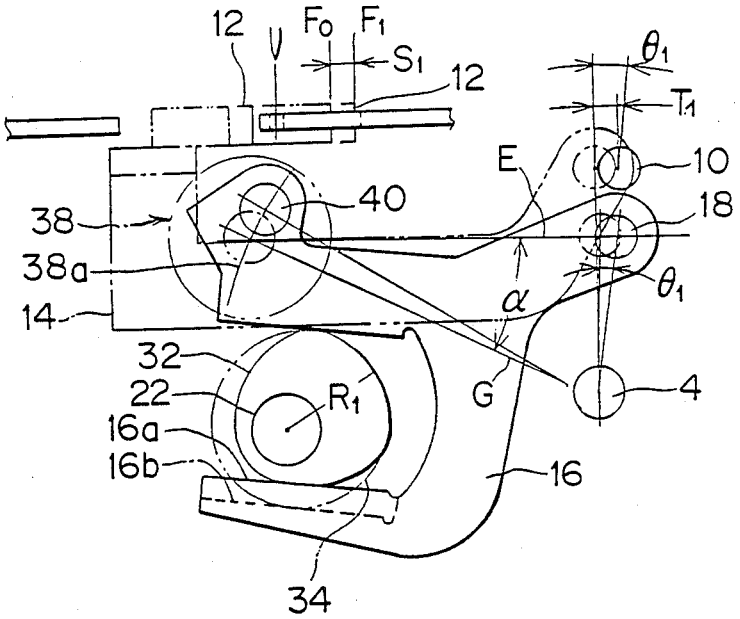
FIGS. 3 and 4 are elevational views for explaining functions of a first feeding mode.

A feed fork 16 is, as shown in FIG. 3, turnably held around a pin 18 near the arm 4*b*. A vertical feed cam 20 is fixed on a lower shaft 22, and gives up and down movements to the feed dog 12 via the base 14. A gear 24 fixed on the lower shaft 22 engages a gear 28 of a loop taker 26 thereby to rotate the loop taker 26 in synchronism by the lower shaft 22.

Figure 7:
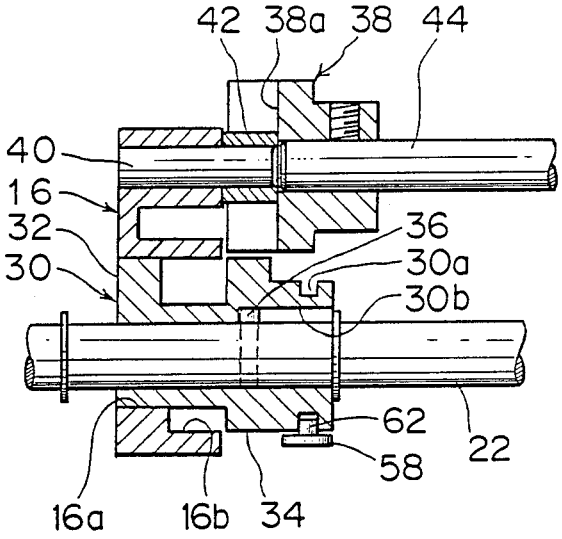
FIGS. 7 and 8 are vertically cross sectional views of the element part of the fabric feed device, and the former shows selection of the first feeding mode, and the latter shows selection of the second feeding mode.

The lower shaft 22 is mounted with a cam body 30. Said cam body 30 is formed with a plurality of horizontal feed cams comprising a first cam 32 and a second cam 34, and is formed with a switching groove 30*a*. The cam body 30 is engaged as seen in FIG. 7 in an oblong groove 30*b*, with a pin 36 of the lower shaft 22, so that the cam body 30 is limited with respect to the lower shaft 22 but slidable in an axial direction.

The first and second cams 32 and 34 are equal in width, but different in effective diameter as seen in FIG. 3 so that swinging movements, i.e., operational amounts thereof are made different accordingly. These cams 32, 34 are switched in the axial direction at a specified interval phase of the upper shaft, and selectively engaged with the feed fork 16 in a manner that the first cam 32 is engaged with a first fork portion 16*a* of the feed fork 16, and the second cam 34 is engaged with a second fork portion 16*b* thereof, and in this succession the feeding mode becomes the first feeding mode or the second feeding mode.

A feed regulator 38 is mounted on a shaft 44 and has a groove 38*a* for receiving a square member 42 as a slide member rotatably held on a pin 40 of the feed fork 16. A regulating arm 46 is fixed on the shaft 44 and communicated with a pin 54 of an output link of a feed stepping motor 52 via a pin 48 and a feed rod 50, so that obliquity of the feed regulator 38 may be determined stepwise by controlling rotation of the feed stepping motor 52.

With respect to a switching means 56 of the cam body 30, the switching lever 58 is pivoted to the machine frame by a stepped screw 60. A pin 62 at one end of the switching lever 58 is engaged with a switching groove 30*a* of the cam body 30, while a pin 64 at the other end is connected to a plunger 70 of a solenoid 68 via a rod 66. The switching lever 58 is biased clockwise of FIG. 1 around the stepped screw 60.

When the solenoid 68 is turned ON and the switching lever 58 is rotated counterclockwise of FIG. 1 against the force of the spring 72, the cam body 30 moves on the lower shaft 22 to the left side of FIG. 1 via the pin 62 and the switching groove 30*a*, and the second cam 34 is engaged with the feed fork 16. If the solenoid is turned OFF under this condition, the switching lever 58 is rotated clockwise around the stepped screw 60 by the force of the spring 72, and the cam body 30 moves to the right side, and the first cam 32 is engaged with the feed fork 16.

By switching the cam body 30, the feeding mode is switched. In the present embodiment, a plurality of stitching patterns are selected by a tenkey 76 for inputting pattern number disposed in a panel 74 of the sewing machine and pattern selecting keys 78, 80. Said patterns are in advance classified in feeding modes. Said feeding mode is selected at the same time as selecting the stitching pattern. In addition, the panel 74 is disposed with manual keys 82, 84, and the first feeding mode or the second one is selected by pushing either one of the manual keys 82 and 84.

A further reference will be made to functions of the embodiment of this invention. If the solenoid is turned OFF in response to the selection of the patterns or by operation of the manual key 82, the first fork portion 16*a* of the feed fork 16 is, as seen in FIG. 7, engaged with the first cam 32, and the feed of the first feeding mode is carried out.

Figure 4:
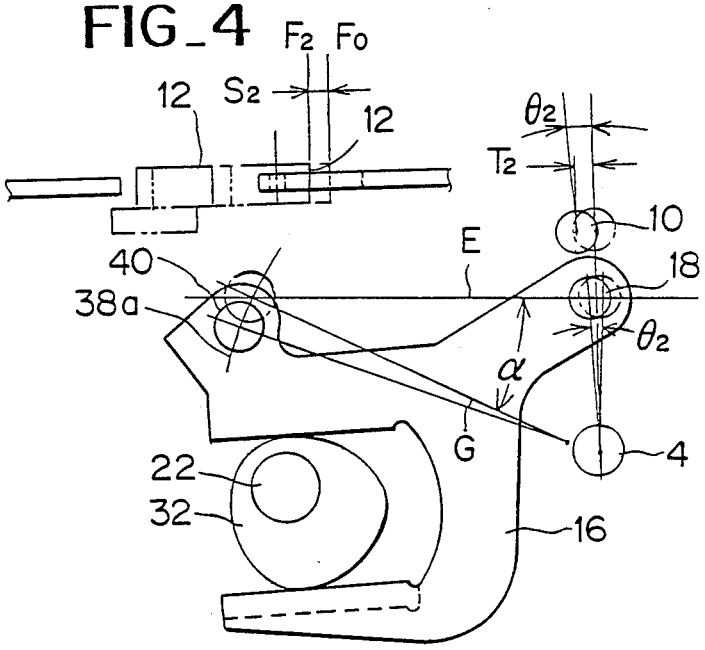

For the explanation, the drawings and letters of FIGS. 3 and 4 will be referred to.

The oblique angle $\alpha$ of the feed regulator 38 is expressed with an angle of a segment G with respect to a segment E.

Herein,

Segment E: a segment combining an axis of a pin 18 and an axis of a pin 40, when the axes of pin 40 and the shaft 44 are aligned.

Segment G: a segment of a normal line in an axis of the shaft 44 of groove 38*a* of the feed regulator 38.

A position of $F_0$ is a horizontal position of the feed dog 12 when the feed dog 12 is raised and the axis of the pin 40 aligns with the axis of the shaft 44.

The position of $F_0$ is $\alpha=0$ (feed control amount 0), and it is in agreement with the horizontal position of the feed dog 12 when the feed dog 12 is raised. The zero position of $F_0$ will be called as "the position of feeding" hereinafter.

In FIGS. 3 and 4, the positions of the members in response to the zero position F of the feeding 0 are shown with two-dotted-lines, and these positions will be called as "zero position" of the members. A value of the obliquity $\alpha$ of the feed regulator 38 is determined at a value of the maximum forward feed (5 mm).

When the feed fork 16 is turned up to the maximum upper position by the first cam 32 as shown in FIG. 3, the pin 40 is raised following the groove 38*a* of the feed regulator 38 via the slide member 42 up to a position of a solid line, and the pins 18, 10 come to the positions of the solid line while the feed dog 12 comes to a position of $F_1$ shown with the solid line in FIG. 3.

With respect to the positions of the solid line of the above mentioned members, the pin 18 is biased clockwise by the angle $\theta_1$ around the rocking shaft 4, when each of the members is at the position 0 under such a condition that the first cam 32 is further rotated and the pin 40 is positioned at the position 0 shown with the two-dotted-line. Accordingly, the pin 10 is also biased clockwise by the angle $\theta_1$ around the rocking shaft 4, and the component $T_1$ in the horizontal direction of the pin 10 with respect to the angle $\theta_1$ is equal to a distance $S_1$ between the end portions $F_0$ and $F_1$ of the feed dog 12.

The first cam 32 is further rotated from the condition of FIG. 3, and the pin 40 passes the position of the two-dotted-line via the feed fork 16. When the feed fork 16 is turned down to the maximum low position as shown in FIG. 4, the pin 40 comes to the position of the solid line, and at the same time the pins 18, 10 comes to the position of the solid line, and the feed dog 12 comes at its end portion to the position of $F_2$.

With respect to the position of the solid line of the above mentioned members, the pins 18 and 10 are biased counterclockwise by the angle $\theta_2$ around the rocking shaft 4, and the component $T_2$ in the horizontal direction of the pin 10 with respect to the angle $\theta_2$ is equal to the distance between the end portions $F_0$ and $F_2$ of the feed dog 12.

Figure 10:
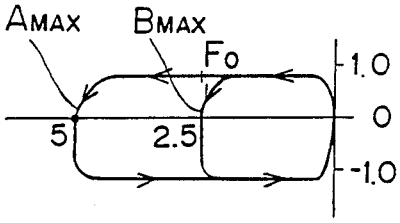
FIG. 10 shows moving loci of a feed dog at the maximum forward feed in the first and second feed modes.

The total of the distances $S_1$ and $S_2$ is the maximum feeding amount, and is composed with the up and down movement of a vertical feed cam 20 by a subsequent rotation of the first cam 32, thereby to draw a locus at the maximum forward feed in the first mode shown with A-max of FIG. 10.

In the present embodiment, the feed of the first feeding mode causes an energization stepping number at the maximum forward feed to respond to 30 in reference to an energization phase at the feeding amount 0 of a feed stepping motor 52, and the maximum forward feed is divided stepwise. This condition is shown with Af in FIG. 9. In the same, Ab shows the energization stepping number of backward feed side and the backward feeding amount in the first feeding mode. Herein, the energization stepping number of the backward feed side is reversed of a forward feed side.

Figure 8:
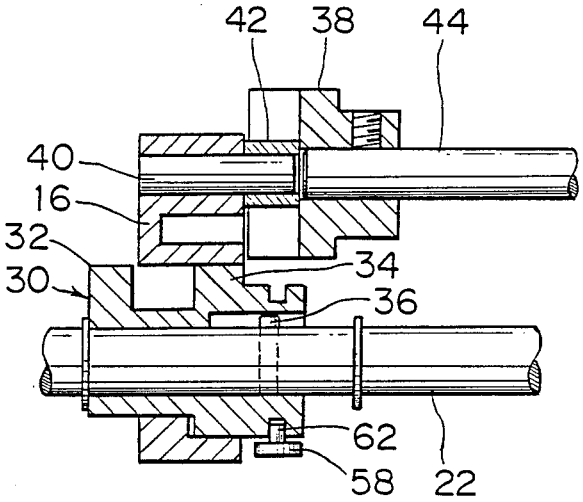

When the solenoid 68 is turned ON from the feeding condition of the first mode of FIG. 3 in response to the selection of the patterns or by the pushing operation of the manual key 84 without changing the oblique angle $\alpha$ of the feed regulator 38, the second cam 34 is engaged with the second fork portion 16*b* of the feed fork 16 as shown in FIG. 8, and the feed of the second feeding mode is continued.

Figure 5:
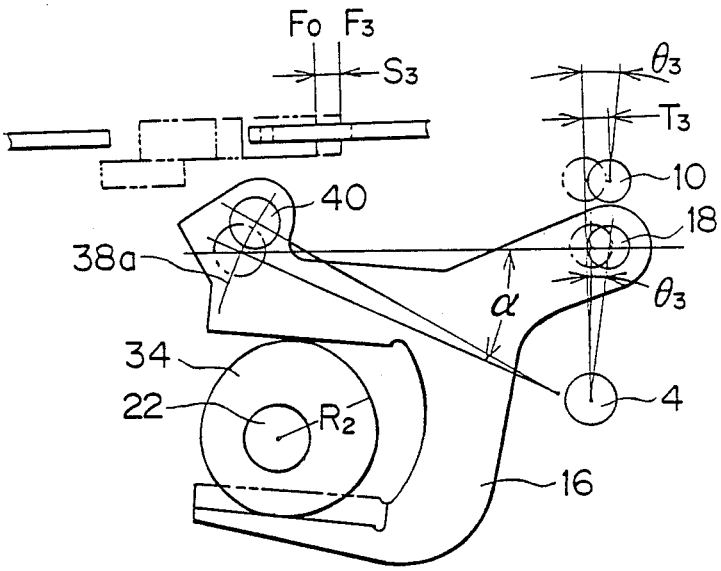
FIGS. 5 and 6 are elevational views for explaining functions of a second feeding mode.
Figure 6:
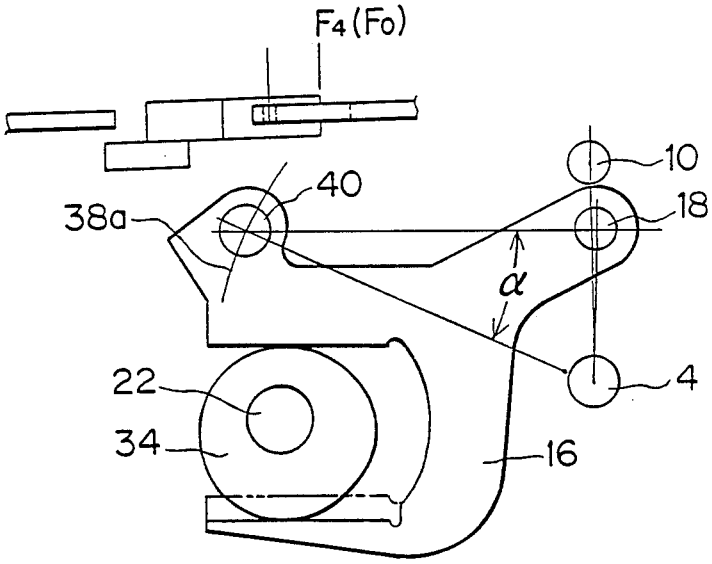

In FIGS. 5 and 6, the position $F_0$ is the same as the position of the first feeding mode and is positioned at the zero feeding position. The positions of the members in response to the position $F_0$ of the zero feed are shown with the two-dotted-lines, and these positions will be referred to as "zero position" of the respective members.

When the feed fork 16 are turned up to the maximum upper position by the second cam 34 as shown in FIG. 5, the pin 40 is raised following the groove 38*a* of the feed regulator 38 via the sliding member 42 up to a position of a solid line, and the pins 18, 10 come to the positions of the solid line while the feed dog 12 comes at its end portion to a position of $F_3$ shown with the solid line.

With respect to the positions shown with the solid line of the above mentioned members, the pins 18 and 10 are biased clockwise by the angle $\theta_3$ around of the rocking shaft 4, when each of the members is at the zero position under such a condition that the second cam 34 is further rotated and the pin 40 is positioned at the position 0 shown with the two-dotted-line. The component $T_3$ in the horizontal direction of the pin 10 with respect to the angle $\theta_1$ is equal to a distance $S_3$ between the end portions $F_0$ and $F_3$ of the feed dog 12.

The second cam 34 is further rotated from the condition of FIG. 5, and when the feed fork 16 is turned down to the maximum low position as shown in FIG. 6 by the second cam 34, the pin 40 comes to the position of the solid line, and at the same time the pins 18, 10 come to the position of the solid line and the feed dog 12 comes to the position of $F_4$ at its end portion.

In this embodiment, the second cam 34 is composed such that the positions shown with the solid line of the members agree to the zero positions of these members, and that the radius $R_2$ of the large diameter side is equal to the radius $R_1$ of the large diameter side of the first cam 32. Therefore, the feed starting position $F_3$ of the second feeding mode agrees to the feed starting position $F_1$ of the first feeding mode. The maximum forward feed amount $S_3$ of the second feeding mode is equal to the distance $S_1$ of the first feeding mode. Since the distance $S_1$ may be equal to the distance $S_2$ in the first feeding mode, $S_3=S_1=2.5$ mm is obtained, and so the maximum forward feed amount of the second feeding mode is 2.5 mm and is composed with the up and down movement of a vertical feed cam 20 by a subsequent rotation of the second cam 32, thereby to draw a locus at the maximum forward feed in the second feeding mode shown with B-max in FIG. 10.

Therefore, if the second feeding mode is used to the sewing by the feed of small pitch (1.5 to 2.5 mm) of the most frequently used straight stitching, and since the position at the initial feed is nearer to the operator than the conventional one, the fabric feed at the initial feed of the fabric edge may be performed conveniently.

Figure 9:
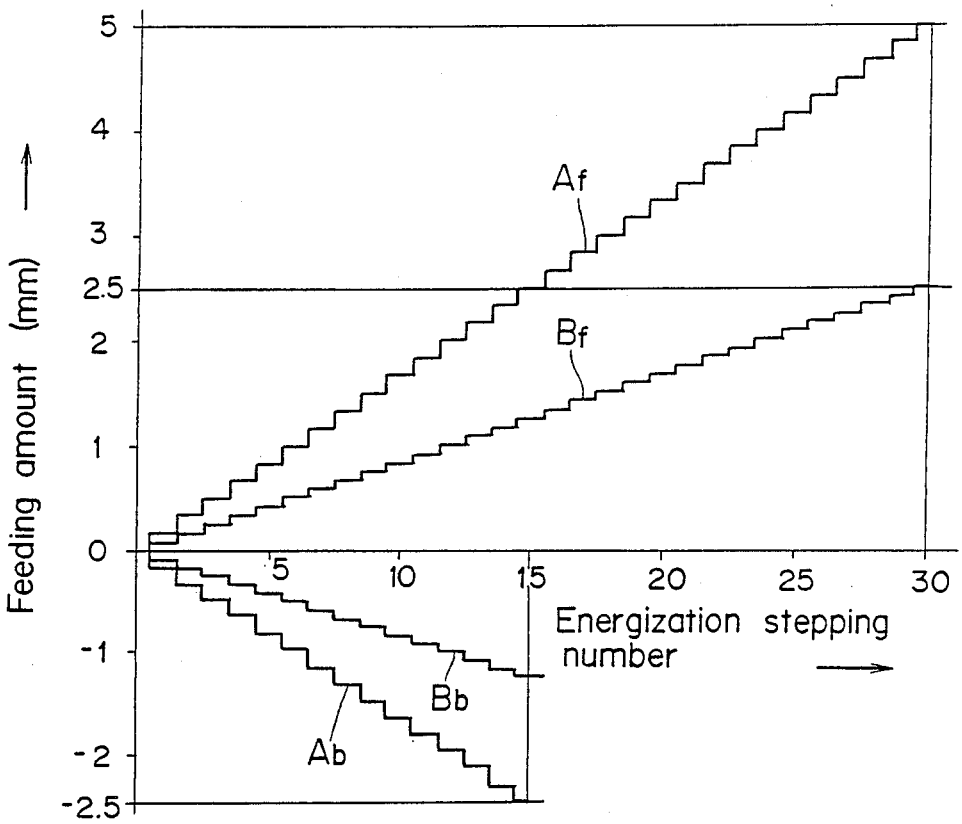
FIG. 9 is a graph showing relationship between an energization stepping number and a feeding amount in the first and second feeding modes.
Figure 11:
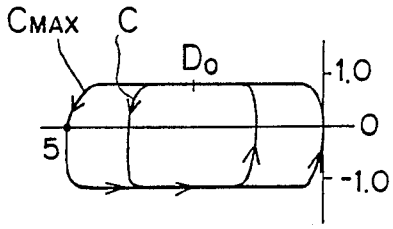
FIG. 11 shows moving loci of the feed dog at the maximum forward feed and a smaller forward feed than said maximum in the prior art.

Since the energization stepping number for giving the maximum forward feed of the second feeding mode is the same as the energization stepping number 30 at the maximum forward feed of the first feeding mode, the feeding pitch regulating step of about ½ of Af as shown with Bf in FIG. 9. Bb shows the energization stepping number and the backward feeding amount of the backward feed side in the first feeding mode. Herein, the energization stepping number of the backward feed side is reversed of the forward feed side.

Thus, according to the present invention, when the small pitches (0.3 to 0.5 mm) are required to buttonhole stitching or satin stitching, the second feeding mode enables fine adjustment.

What is claimed is:

1. A fabric feed device of a sewing machine that has a needle, comprising:

means for feeding a fabric to be sewn and including a movable feed dog;

means for moving said feed dog horizontally and vertically so as to move said feed dog along a trapezoidal path and thereby transport the fabric to be sewn relative to a needle, said moving means including a swingably movable fork member arranged so as to move said feed dog horizontally;

a lower shaft;

cam means having a plurality of cams rotatably movable on said lower shaft, each of said cams being selectively engagable to operatively engage with said fork member and being formed so that said fork member has a different swingable movement dependent upon which of said cams is operatively engaged therewith, each of said cams being associated with a corresponding fabric feeding mode;

switch means for selectively engaging a respective one of said cams;

means for classifying a plurality of stitch patterns by said fabric feeding modes; and means for selecting a respective one of said stitch patterns and therefore also a corresponding one of said fabric feeding modes, said switch means being responsive to said selecting means to engage one of said cams associated with said corresponding one of said fabric feeding modes.

2. The fabric feed device as defined in claim 1; further comprising:

second means for selecting said fabric feeding mode directly, said switch means being responsive to said second means to engage said respective one of said cams.

3. The fabric feed device as defined in claim 1; further comprising:

a rocking shaft with an arm extending therefrom, said fork member being pivotally connected to arm of said rocking shaft so that said fork member is swingably movable relative to said arm to move said feed dog horizontally, said moving means further including vertical cam means for moving said feed dog vertically and means for regulating said swinging movement of said fork member.

4. The fabric feed device as defined in claim 3, wherein said regulating means is slidably connected with said fork member; further comprising:

means for obliquely positioning said regulating means relative to said fork member and thereby regulated a swinging movement of said fork member and including a feed stepping motor rotatably driving said regulating means; and means for determining an oblique position of said regulating means relative to said fork member and including means for controlling rotation of said feed stepping motor.

5. The fabric feed device as defined in claim 1, wherein said moving means includes vertical cam means arranged to vertically move said feed dog up and down.

6. The fabric feed device as defined in claim 1, wherein said plurality of cams includes two cams adjacent to each other and each having effective diameters different from each other with at least one portion having a radius equal to each other.

7. A fabric feed device of a sewing machine that has a needle, comprising:

means for feeding a fabric to be sewn and including a feed dog movable between two end positions horizontally;

a fork member swingably movable and operatively connected to said feed dog to move said feed dog horizontally in association therewith;

a rocking shaft with an extended arm, said fork member being pivotally connected to said arm;

cam means including a plurality of cams having different effective diameters, said cams being selectively engagable with said fork member so that said fork member has different swingable movements depending upon which of said cams is selectively engaged therewith;

means for pivotally connecting said fork member to said arm and including a first pin extending from one of said fork member and said arm;

means for regulating said swingable movement of said fork member and including a regulating shaft;

means for obliquely connecting said regulating shaft and said fork member and including a second pin and a groove, said second pin extending from one of said fork member and said regulating means, said groove being formed in the other of said fork member and said regulating means and arranged so that said second pin is obliquely movable in said groove;

means for rotating said regulating shaft and including a stepping motor drivably connected to said regulating shaft; and switch means for selectively engaging a respective one of said cams, said fork member being arranged to selectively engage a first of said cams and thereby provide a first feeding mode so as to move into a zero position in which said first pin and said second pin are aligned with each other in a common horizontal plane and causing said feed dog to move between said end positions, said fork member being movable by said first of said cams from said zero position into a first position in which said feed dog moves to one of said two end positions and in which said stepping motor is driven to provide a maximum forward feed of said first feeding mode, said feed member thereafter being movable back through said zero position to a third position in which said feed dog moves to a second of said two end positions, said fork member being arranged to selectively engage a second of said cams and thereby provide a second feeding mode for fine adjustment so that said fork member is movable by said second of said cams from said zero position into a third position in which said said feed dog moves to said one of said end positions and in which said stepping motor is driven to provide a maximum forward feed of said second feeding mode that is the same as said maximum forward feed of said first feeding mode, said fork member being formed to thereafter be movable back by said second of said cams no further than to a fourth position corresponding to said zero position causing said feed dog to move back between said two end positions corresponding to said zero position, said first of said cams and said second of said cams being formed so that said first and said third positions into which said fork member is movable are identical.

* * * * *